US007585037B2

(12) United States Patent
Tabata et al.

(10) Patent No.: US 7,585,037 B2
(45) Date of Patent: Sep. 8, 2009

(54) LIQUID JET APPARATUS AND PRINTING APPARATUS

(75) Inventors: Kunio Tabata, Shiojiri (JP); Atsushi Oshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 136 days.

(21) Appl. No.: 11/780,390

(22) Filed: Jul. 19, 2007

(65) Prior Publication Data

US 2008/0018687 A1 Jan. 24, 2008

(30) Foreign Application Priority Data

Jul. 24, 2006 (JP) ..... 2006-200353
Jul. 13, 2007 (JP) ..... 2007-184439

(51) Int. Cl.
*B41J 29/38* (2006.01)

(52) U.S. Cl. ..... 347/10; 347/11

(58) Field of Classification Search ..... 347/10
See application file for complete search history.

(56) References Cited

U.S. PATENT DOCUMENTS 6,312,076 B1 * 11/2001 Taki et al. ..... 347/10
6,474,762 B2 * 11/2002 Taki et al. ..... 347/10
7,244,007 B2 7/2007 Ishizaki
2005/0231179 A1 10/2005 Ishizaki
2008/0018683 A1 1/2008 Oshima et al.
2008/0018685 A1 1/2008 Tabata et al.
2008/0018687 A1 1/2008 Tabata et al.
2008/0100652 A1 5/2008 Oshima et al.
2008/0218545 A1 9/2008 Oshima et al.

FOREIGN PATENT DOCUMENTS

JP 11-204850 7/1999
JP 2003-001824 1/2003

* cited by examiner

*Primary Examiner*—Matthew Luu
*Assistant Examiner*—Brian J Goldberg
(74) *Attorney, Agent, or Firm*—Workman Nydegger

(57) ABSTRACT

A liquid jet apparatus includes a plurality of nozzles provided to a liquid jet head, an actuator provided corresponding to each of the nozzles, and drive unit for applying a drive pulse to the actuator, wherein the drive unit includes drive waveform signal generation unit that generates one or more of drive waveform signals each providing basis of the drive pulse to the actuator, one or more of transistor pairs provided as many as the number of the actuators in order for power-amplifying the one or more of drive waveform signals generated by the drive waveform signal generation unit, and each having two transistors forming a pair and connected to each other in a push-pull manner, and one or more of low-pass filters provided as many as the number of the actuators and each disposed between a connection point of the transistor pair and the actuator.

10 Claims, 13 Drawing Sheets

| | |
|---|---|
| ADDRESS 1 | NOZZLE 1 SMALL INK DROPLET WAVEFORM DATA |
| ADDRESS 2 | NOZZLE 1 MEDIUM INK DROPLET WAVEFORM DATA |
| ADDRESS 3 | NOZZLE 1 LARGE INK DROPLET WAVEFORM DATA |
| ADDRESS 4 | NOZZLE 2 SMALL INK DROPLET WAVEFORM DATA |
| ADDRESS 5 | NOZZLE 2 MEDIUM INK DROPLET WAVEFORM DATA |
| ADDRESS 6 | NOZZLE 2 LARGE INK DROPLET WAVEFORM DATA |
| ⋮ | ⋮ |
| ADDRESS M-5 | NOZZLE N-1 SMALL INK DROPLET WAVEFORM DATA |
| ADDRESS M-4 | NOZZLE N-1 MEDIUM INK DROPLET WAVEFORM DATA |
| ADDRESS M-3 | NOZZLE N-1 LARGE INK DROPLET WAVEFORM DATA |
| ADDRESS M-2 | NOZZLE N SMALL INK DROPLET WAVEFORM DATA |
| ADDRESS M-1 | NOZZLE N MEDIUM INK DROPLET WAVEFORM DATA |
| ADDRESS M | NOZZLE N LARGE INK DROPLET WAVEFORM DATA |

FIG.11A

| | |
|---|---|
| ADDRESS 1 | SMALL INK DROPLET WAVEFORM DATA A |
| ADDRESS 2 | MEDIUM INK DROPLET WAVEFORM DATA A |
| ADDRESS 3 | LARGE INK DROPLET WAVEFORM DATA A |
| ADDRESS 4 | SMALL INK DROPLET WAVEFORM DATA B |
| ADDRESS 5 | MEDIUM INK DROPLET WAVEFORM DATA B |
| ADDRESS 6 | LARGE INK DROPLET WAVEFORM DATA B |
| ADDRESS 7 | SMALL INK DROPLET WAVEFORM DATA C |
| ADDRESS 8 | MEDIUM INK DROPLET WAVEFORM DATA C |
| ADDRESS 9 | LARGE INK DROPLET WAVEFORM DATA C |
| ADDRESS 10 | SMALL INK DROPLET WAVEFORM DATA D |
| ADDRESS 11 | MEDIUM INK DROPLET WAVEFORM DATA D |
| ADDRESS 12 | LARGE INK DROPLET WAVEFORM DATA D |
| ⋮ | ⋮ |

FIG.11B

LIQUID JET APPARATUS AND PRINTING APPARATUS

BACKGROUND

1. Technical Field

The present invention relates to a liquid jet apparatus and printing apparatus arranged to print predetermined letters and images by emitting microscopic droplets of liquids from a plurality of nozzles to form the microscopic particles (dots) thereof on a printing medium.

2. Related Art

An inkjet printer as one of such printing apparatuses, which is generally low-price and easily provides high quality color prints, has widely been spreading not only to offices but also to general users along with the widespread of personal computers or digital cameras.

Further, in recent inkjet printers, printing in fine tone is required. Tone denotes a state of density of each color included in a pixel expressed by a liquid dot, the size of the dot corresponding to the color density of each pixel is called a tone grade, and the number of the tone grades capable of being expressed by a liquid dot is called a tone number. The fine tone denotes that the tone number is large. In order for changing the tone grade, it is required to modify a drive pulse to an actuator provided to a liquid jet head. In the case in which a piezoelectric element is used as the actuator, since an amount of displacement of the piezoelectric element (distortion of a diaphragm, to be precise) becomes large while a voltage value applied to the piezoelectric element becomes large, the tone grade of the liquid dot can be changed using this phenomenon.

Therefore, in JP-A-2003-1824, it is arranged that a plurality of drive pulses with different wave heights is combined and joined, the drive pulses are commonly output to the piezoelectric elements of the nozzles of the same color provided to the liquid jet head, a drive pulse corresponding to the tone grade of the liquid dot to be formed is selected for every nozzle out of the plurality of drive pulses, the selected drive pulses are supplied to the piezoelectric elements of the corresponding nozzles to emit droplets of the liquid different in weight, thereby achieving the required tone grade of the liquid dot.

However, in the past inkjet printer, there is a problem that the waveform of the drive pulse is distorted by the parasitic inductance, the parasitic capacitance, and the resistance of the wiring of the drive circuit, and the capacitance of the actuator such as a piezoelectric element, and moreover, the amount of the waveform distortion varies in accordance with the number of the actuators such as the piezoelectric elements driven by the drive pulse. The waveform distortion of the drive pulse leads to variation in the weight of the liquid, causing variation in the size of the liquid dot, thus leading to degradation of the print quality. It should be noted that the variation in the weight of the liquid also depends on the individual difference of the nozzle or the actuator. Further, in the case in which a plurality of drive pulses is combined in chronological order and joined to each other, the drive pulse corresponding to the tone grade of a liquid dot to be formed is selected for every nozzle from the plurality of drive pulses, and the selected drive pulse is applied to the actuator of the corresponding nozzle, there is caused a shift in the liquid jet emission timing between the nozzles of the actuators for which the different drive pulses are selected, thus the liquid dot forming (or landing) positions are varied to cause degradation of the print quality.

SUMMARY

The present invention has an object of providing a liquid jet apparatus and a printing apparatus capable of preventing the waveform distortion of the drive pulse, suppressing and preventing the variation in the weight of the liquid, and preventing the shift in the liquid jet emission timing, thereby achieving the high-quality and fine tone printing.

A liquid jet apparatus according to the present invention is a liquid jet apparatus including a plurality of nozzles provided to a liquid jet head, an actuator provided corresponding to each of the nozzles, and drive unit that applies a drive pulse to the actuator, wherein the drive unit includes drive waveform signal generation unit that generates one or more of drive waveform signals each providing basis of the drive pulse to the actuator, one or more of transistor pairs provided as many as the number of the actuators in order for power-amplifying the one or more of drive waveform signals generated by the drive waveform signal generation unit, and each having two transistors forming a pair and connected to each other in a push-pull manner, and one or more of low-pass filters provided as many as the number of the actuators and each disposed between a connection point of the transistor pair and the actuator.

According to the liquid jet apparatus of the invention described above, since only one actuator is arranged to be connected to the drive circuit composed of the transistor pair and the low-pass filter, the waveform distortion of the drive pulse can be prevented, thus the variation in the weight of the liquid to be emitted can be suppressed and prevented to make it possible to perform high quality and fine tone printing.

Further, it is preferable that the liquid jet apparatus includes one or more of modulator unit provided as many as the number of the transistor pairs and for pulse-modulating the drive waveform signal generated by the drive waveform signal generation unit, and one or more of gate drive unit provided as many as the number of the transistor pairs and each driving the transistor pair in accordance with a modulated signal pulse-modulated by the modulator unit, wherein the transistor pair is controlled individually in accordance with the drive waveform signal.

Further, it is preferable that the liquid jet apparatus includes a waveform data memory for storing waveform data corresponding to the actuators, wherein the drive waveform signal generation unit generates the drive waveform signal for each actuator in accordance with the corresponding waveform data stored in the waveform data memory.

According to the liquid jet apparatus of the invention described above, by generating the drive waveform signal corresponding to the actuator of the individual drive circuit and the nozzle, the variation in the weight of the liquid jet to be emitted among the nozzles can be suppressed and prevented, thus high quality and fine tone printing becomes possible.

Further, it is preferable that the drive waveform signal generation unit generates the drive waveform signals simultaneously to all of the actuators corresponding to the nozzles from which the liquid jet is emitted with timing of emitting the liquid jet from the nozzles.

According to the liquid jet apparatus of the invention described above, the shift of the liquid jet emission timing among the nozzles can be prevented, thus the high quality and fine tone printing becomes possible.

Further, it is preferable that the modulator unit, the gate drive unit, the transistor pairs, and the low-pass filters are disposed adjacent to the actuators as an integrated circuit.

Further, the printing apparatus of the invention is preferably a printing apparatus provided with the liquid jet apparatus described above.

According to the printing apparatus of the invention described above, the variation in the weight of the liquid jet to be emitted can be suppressed and prevented, thus the high quality and fine tone printing becomes possible. Further, by disposing the modulator unit, the gate drive unit, the transistor pairs, and the low-pass filters adjacent to the actuators as an integrated circuit, power loss can be reduced to achieve low power consumption, and at the same time, the plurality of liquid jet heads can efficiently be arranged, thus the downsizing of the printing apparatus becomes possible.

BRIEF DESCRIPTION OF THE DRAWINGS

FIG. 1 shows schematic configuration views showing an embodiment of a line head printing apparatus applying the liquid jet apparatus according to the present invention, wherein

FIG. 11 is an explanatory diagram of a waveform data memory.

DESCRIPTION OF EXEMPLARY EMBODIMENTS

An embodiment will be explained with reference to the drawings using a printing apparatus for printing letters and images on a print medium by emitting a liquid jet, as an example of the present invention.

Figure 1A:
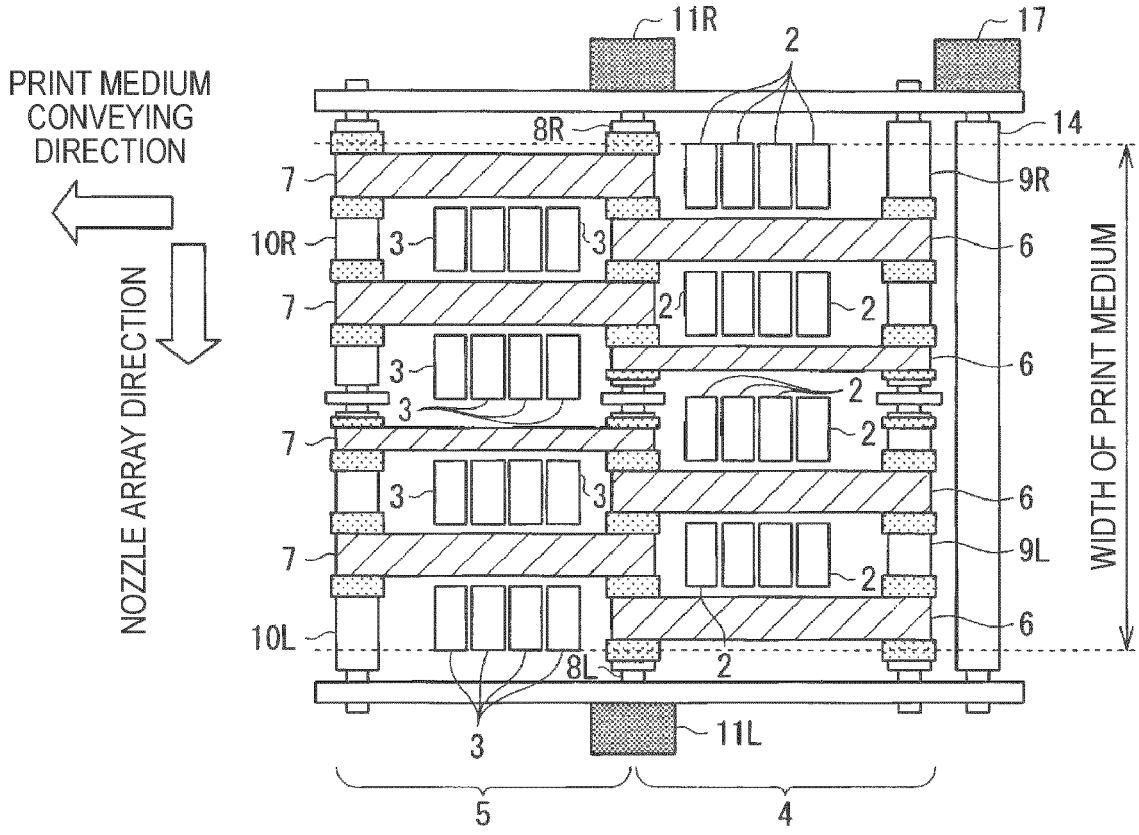
FIG. 1A is a plan view thereof.
Figure 1B:
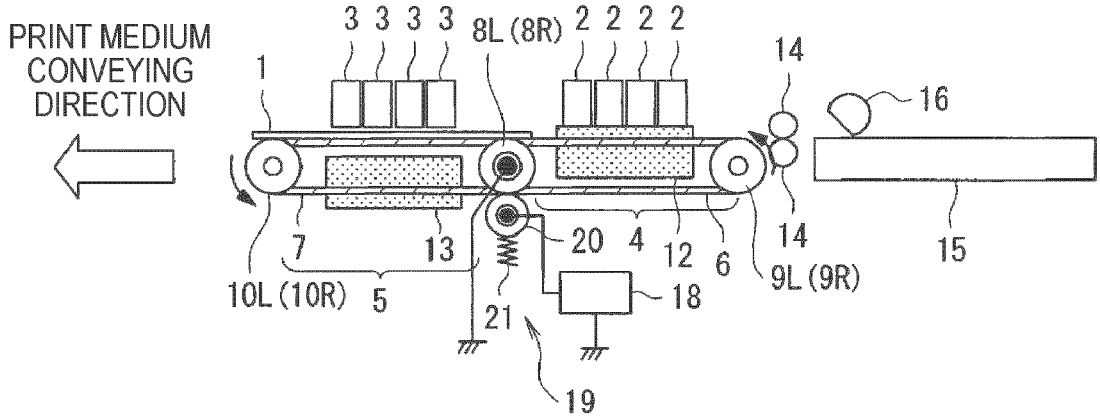
FIG. 1B is a front view thereof.

FIGS. 1A and 1B are schematic configuration views of the printing apparatus according to the present embodiment, wherein FIG. 1A is a plan view thereof, and FIG. 1B is a front view thereof. In FIG. 1, in the line head printing apparatus, a print medium 1 is conveyed from right to left of the drawing along the arrow direction, and is printed in a print area in the middle of the conveying path. It should be noted that the liquid jet head of the present embodiment is not disposed integrally in one place, but is disposed separately in two places.

The reference numeral 2 in the drawing denotes a first liquid jet head disposed on the upstream side in the conveying direction of the print medium 1, the reference numeral 3 denotes a second liquid jet head disposed similarly on the downstream side, a first conveying section 4 for conveying the print medium 1 is disposed below the first liquid jet head 2, and a second conveying section 5 is disposed below the second liquid jet head 3. The first conveying section 4 is composed of four first conveying belts 6 disposed with predetermined intervals in the direction (hereinafter also referred to as a nozzle array direction) traversing the conveying direction of the print medium 1, the second conveying section 5 is similarly composed of four second conveying belts 7 disposed with predetermined intervals in the direction (the nozzle array direction) traversing the conveying direction of the print medium 1.

The four first conveying belts 6 and the similar four second conveying belts 7 are disposed alternately adjacent to each other. In the present embodiment, out of the conveying belts 6, 7, the two first and second conveying belts 6, 7 in the right side in the nozzle array direction are distinguished form the two first and second conveying belts 6, 7 in the left side in the nozzle array direction. In other words, an overlapping portion of the two of the first and second conveying belts 6, 7 in the right side in the nozzle array direction is provided with a right side drive roller 8R, an overlapping portion of the two of the first and second conveying belts 6, 7 in the left side in the nozzle array direction is provided with a left side drive roller 8L, a right side first driven roller 9R and left side first driven roller 9L are disposed on the upstream side thereof, and a right side second driven roller 10R and left side second driven roller 10L are disposed on the downstream side thereof. Although these rollers may seem a series of rollers, actually they are decoupled at the center portion of FIG. 1A.

Further, the two first conveying belts 6 in the right side in the nozzle array direction are wound around the right side drive roller 8R and the right side first driven roller 9R, the two first conveying belts 6 in the left side in the nozzle array direction are wound around the left side drive roller 8L and the left side first driven roller 9L, the two second conveying belts 7 in the right side in the nozzle array direction are wound around the right side drive roller 8R and the right side second driven roller 10R, the two second conveying belts 7 in the left side in the nozzle array direction are wound around the left side drive roller 8L and the left side second driven roller 10L, and further, a right side electric motor 11R is connected to the right side drive roller 8R, and a left side electric motor 11L is connected to the left side drive roller 8L. Therefore, when the right side electric motor 11R rotationally drives the right side drive roller 8R, the first conveying section 4 composed of the two first conveying belts 6 in the right side in the nozzle array direction and similarly the second conveying section 5 composed of the two second conveying belts 7 in the right side in the nozzle array direction move in sync with each other and at the same speed, while the left side electric motor 11L rotationally drives the left side drive roller 8L, the first conveying section 4 composed of the two first conveying belts 6 in the left side in the nozzle array direction and similarly the second conveying section 5 composed of the two second conveying belts 7 in the left side in the nozzle array direction move in sync with each other and at the same speed.

It should be noted that by arranging the rotational speeds of the right side electric motor 11R and the left side electric motor 11L to be different from each other, the conveying speeds in the left and right in the nozzle direction can be set different from each other, specifically, by arranging the rotational speed of the right side electric motor 11R higher than the rotational speed of the left side electric motor 11L, the conveying speed in the right side in the nozzle array direction can be made higher than that in the left side, and by arranging the rotational speed of the left side electric motor 11L higher than the rotational speed of the right side electric motor 11R, the conveying speed in the left side in the nozzle array direction can be made higher than that in the right side.

The first liquid jet head 2 and the second liquid jet head 3 are disposed by a unit of colors, yellow (Y), magenta (M), cyan (C), and black (K) shifted in the conveying direction of the print medium 1. The liquid jet heads 2, 3 are supplied with liquids from liquid tanks of respective colors not shown via liquid supply tubes. Each of the liquid jet heads 2, 3 is provided with a plurality of nozzles formed in the direction (namely, the nozzle array) direction traversing the conveying direction of the print medium 1, and by emitting a necessary amount of the liquid jet from the respective nozzles simultaneously to the necessary positions, microscopic liquid dots are formed on the print medium 1. By performing the process described above by the unit of the colors, one-pass print can be achieved only by making the print medium 1 conveyed by the first and second conveying sections 4, 5 pass therethrough once. In other words, the area in which the liquid jet heads 2, 3 are disposed corresponds to the print area.

As a method of emitting liquid jets from each of the nozzles of the liquid jet heads, an electrostatic method, a piezoelectric method, and a film boiling jet method and so on can be cited. In the electrostatic method, when a drive signal is provided to an electrostatic gap as an actuator, a diaphragm in a cavity is displaced to cause pressure variation in the cavity, and the liquid jet is emitted from the nozzle in accordance with the pressure variation. In the piezoelectric method, when a drive signal is provided to a piezoelectric element as an actuator, a diaphragm in a cavity is displaced to cause pressure variation in the cavity, and the liquid jet is emitted from the nozzle in accordance with the pressure variation. In the film boiling jet method, a microscopic heater is provided in the cavity, and is instantaneously heated to be at a temperature higher than 300° C. to make the liquid become the film boiling state to generate a bubble, thus causing the pressure variation making the liquid jet be emitted from the nozzle. The present invention can apply either liquid jet methods, and among others, the invention is particularly preferable for the piezoelectric element capable of adjusting a liquid jet amount by controlling the wave height or gradient of increase or decrease in the voltage of the drive signal.

The liquid jet emission nozzles of the first liquid jet head 2 are only provided between the four first conveying belts 6 of the first conveying section 4, the liquid jet emission nozzles of the second liquid jet head 3 are only provided between the four second conveying belts 7 of the second conveying section 5. Although this is for cleaning each of the liquid jet heads 2, 3 with a cleaning section described later, in this case, the entire surface is not printed by the one-pass printing if either one of the liquid jet heads is used. Therefore, the first liquid jet head 2 and the second liquid jet head 3 are disposed shifted in the conveying direction of the print head 1 in order for compensating for each other's unprintable areas.

What is disposed below the first liquid jet head 2 is a first cleaning cap 12 for cleaning the first liquid jet head 2, and what is disposed below the second liquid jet head 3 is a second cleaning cap 13 for cleaning the second liquid jet head 3. Each of the cleaning caps 12, 13 is formed to have a size allowing the cleaning caps to pass through between the four first conveying belts 6 of the first conveying section 4 and between the four second conveying belts 7 of the second conveying section 5. Each of the cleaning caps 12, 13 is composed of a cap body having a rectangular shape with a bottom, covering the nozzles provided to the lower surface, namely a nozzle surface of the liquid jet head 2, 3, and capable of adhering the nozzle surface, a liquid absorbing body disposed at the bottom, a peristaltic pump connected to the bottom of the cap body, and an elevating device for moving the cap body up and down. Then, the cap body is moved up by the elevating device to be adhered to the nozzle surface of the liquid jet head 2, 3. By causing the negative pressure in the cap body using the peristaltic pump in the present state, the liquid and bubbles are suctioned from the nozzles opened on the nozzle surface of the liquid jet head 2, 3, thus the cleaning of the liquid jet head 2, 3 can be performed. After the cleaning is completed, each of the cleaning caps 12, 13 is moved down.

On the upstream side of the first driven rollers 9R, 9L, there provided a pair of gate rollers 14 for adjusting the feed timing of the print medium 1 from a feeder section 15 and at the same time correcting the skew of the print medium 1. The skew denotes a turn of the print medium 1 with respect to the conveying direction. Further, above the feeder section 15, there is provided a pickup roller 16 for feeding the print medium 1. It should be noted that the reference numeral 17 in the drawing denotes a gate roller motor for driving the gate rollers 14.

A belt charging device 19 is disposed below the drive rollers 8R, 8L. The belt charging device 19 is composed of a charging roller 20 having a contact with the first conveying belts 6 and the second conveying belts 7 via the drive rollers 8R, 8L, a spring 21 for pressing the charging roller 20 against the first conveying belts 6 and the second conveying belts 7, and a power supply 18 for providing charge to the charging roller 20, and charges the first conveying belts 6 and the second conveying belts 7 by providing them with the charge from the charging roller 20. Since the belts are generally made of a moderate or high resistivity material or an insulating material, when the they are charged by the belt charging device 19, the charge applied on the surface thereof causes the print medium 1 made similarly of a high resistivity material or an insulating material the dielectric polarization, and the print medium 1 can be absorbed to the belt by the electrostatic force caused between the charge generated by the dielectric polarization and the charge on the surface of the belt. It should be noted that as the belt charging unit, a corotron for showering the charges can also be used.

Therefore, according to the present printing apparatus, when the surfaces of the first conveying belts 6 and the second conveying belts 7 are charged by the belt charging device 19, the print medium 1 is fed from the gate roller 14 in that state, and the print medium 1 is pressed against the first conveying belts 6 by a sheet pressing roller composed of a spur or a roller not shown, the print medium 1 is absorbed by the surfaces of the first conveying belts 6 under the action of dielectric polarization. In this state, when the electric motors 11R, 11L rotationally drive the drive rollers 8R, 8L, the rotational drive force is transmitted to the first driven rollers 9R, 9L via the first conveying belts 6.

Thus, the first conveying belts 6 is moved to the downstream side of the conveying direction while absorbing the print medium 1, printing is performed by emitting liquid jets from the nozzles formed on the first liquid jet head 2 while moving the print medium 1 to below the first liquid jet head 2. When the printing by the first liquid jet head 2 is completed, the print medium 1 is moved downstream side of the conveying direction to be switched to the second conveying belts 7 of the second conveying section 5. As described above, since the second conveying belts 7 are also provided with the charge on the surface thereof by the belt charging device 19, the print medium 1 is absorbed by the surfaces of the second conveying belts 7 under the action of the dielectric polarization.

In the present state, the second conveying belts 7 is moved to the downstream side of the conveying direction, printing is performed by emitting liquid jets from the nozzles formed on the second liquid jet head 3 while moving the print medium 1 to below the second liquid jet head 3. After the printing by the second liquid jet head is completed, the print medium 1 is moved further to the downstream side of the conveying direction, the print medium 1 is ejected to a catch tray while separating it from the surfaces of the second conveying belts 7 by a separating device not shown in the drawings.

Further, when the cleaning of the first and second liquid ejection heads 2, 3 becomes necessary, as described above, the first and second cleaning caps 12, 13 are raised to be adhered to the nozzle surfaces of the first and second liquid jet heads 2, 3, the cleaning is performed by applying negative pressure to the inside of the caps at that state to suction the liquid and bubbles from the nozzles of the first and second liquid jet heads 2, 3, and after then, the first and second cleaning caps 12, 13 are moved down.

Figure 2:
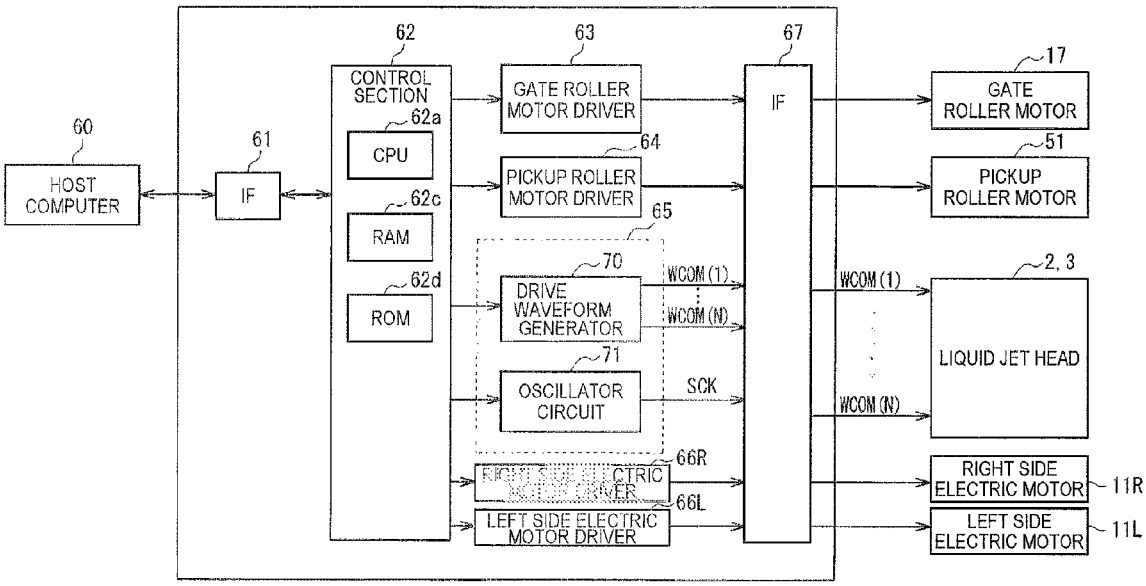
FIG. 2 is a block diagram of a control device of the printing apparatus shown in FIG. 1.

Inside the printing apparatus, there is provided a control device for controlling the device itself. The control device is, as shown in FIG. 2, for controlling the printing apparatus, the feeder device, and so on based on print data input from a host computer 60 such as a personal computer or a digital camera, thereby performing the print process on the print medium. Further, the control device is configured including an input interface section 61 for receiving print data input from the host computer 60, a control section 62 formed of a microcomputer for performing the print process based on the print data input from the input interface section 61, a gate roller motor driver 63 for controlling driving the gate roller motor 17, a pickup roller motor driver 64 for controlling driving a pickup roller motor 51 for driving the pickup roller 16, a head driver 65 for controlling driving the liquid jet heads 2, 3, a right side electric motor driver 66R for controlling driving the right side electric motor 11R, a left side electric motor driver 66L for controlling driving the left side electric motor 11L, and an interface 67 for converting the output signals of the drivers 63 through 65, 66R, 66L into control signals used in the gate roller motor 17, the pickup roller motor 51, the liquid jet heads 2, 3, the right side electric motor 11R, and the left side electric motor 11L outside thereof for output.

The control section 62 is provided with a central processing unit (CPU) 62*a* for performing various processes such as the print process, a random access memory (RAM) 62*c* for temporarily storing the print data input via the input interface 61 and various kinds of data used in performing the print process of the print data, and for temporarily developing an application program such as for the print process, and a read-only memory (ROM) 62*d* formed of a nonvolatile semiconductor memory and for storing the control program executed by the CPU 62*a* and so on. When the control section 62 receives the print data (image data) from the host computer 60 via the interface section 61, the CPU 62*a* performs a predetermined process on the print data to output printing data (drive pulse selection data SI&SP) regarding which nozzle emits the liquid jet or how much liquid jet is emitted, and further outputs the control signals to the respective drivers 63 through 65, 66R, and 66L based on the printing data and the input data from the various sensors. When the control signals are output from the respective drivers 63 through 65, 66R, and 66L, the control signals are converted by the interface section 67 into the drive signals, the actuators (in the present embodiment, the drive circuit in the anterior thereof) corresponding to a plurality of nozzles of the liquid jet heads, the gate roller motor 17, the pickup roller motor 51, the right side electric motor 11R, and the left side electric motor 11L respectively operate, thus the feeding and conveying the print medium 1, posture control of the print medium 1, and the print process to the print medium 1 are performed. It should be noted that the elements inside the control section 62 are electrically connected to each other via a bus not shown in the drawings.

Figure 3:
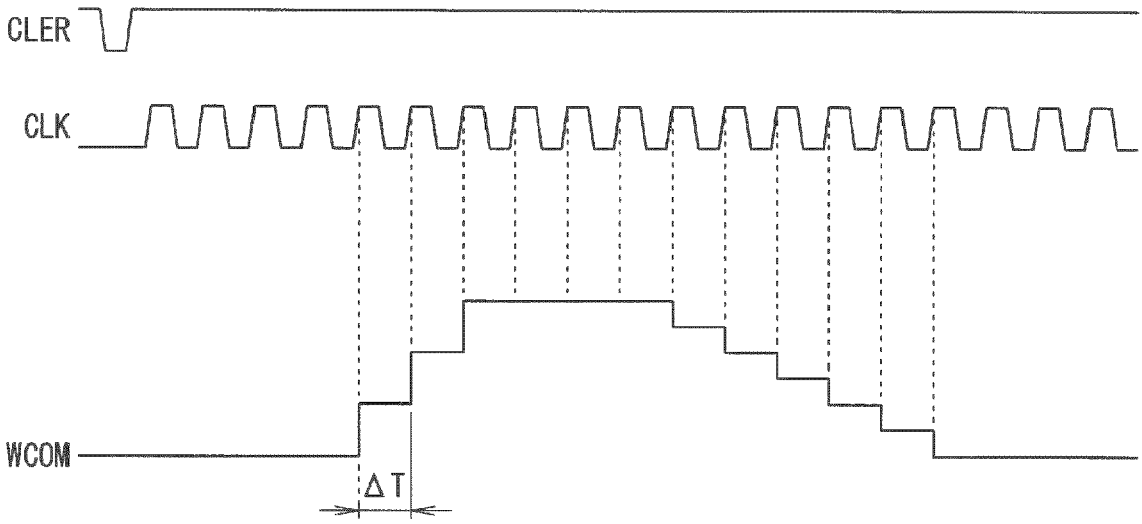
FIG. 3 is an explanatory diagram of generation of the drive waveform signal.

The head driver 65 is provided with a drive waveform generator 70 for forming drive waveform signal WCOM and an oscillator circuit 71 for outputting a clock signal SCK. The drive waveform generator 70 is, as described in detail below, for generating the drive waveform signal WCOM, which becomes the basis for the drive pulse to the actuator 22, and as shown in FIG. 3, after inputting the clear signal CLER, the drive waveform generator 70 retrieves the waveform data stored in the waveform data memory described below and outputs the voltage signal composed of the waveform data to form the drive waveform signal WCOM for every predetermined period $\Delta T$ defined by the clock signal CLK. The drive waveform signal WCOM is power-amplified and converted into the drive pulse to the actuator 22 by the drive circuit composed of a digital power amplifier and a low-pass filter described later.

Figure 4:
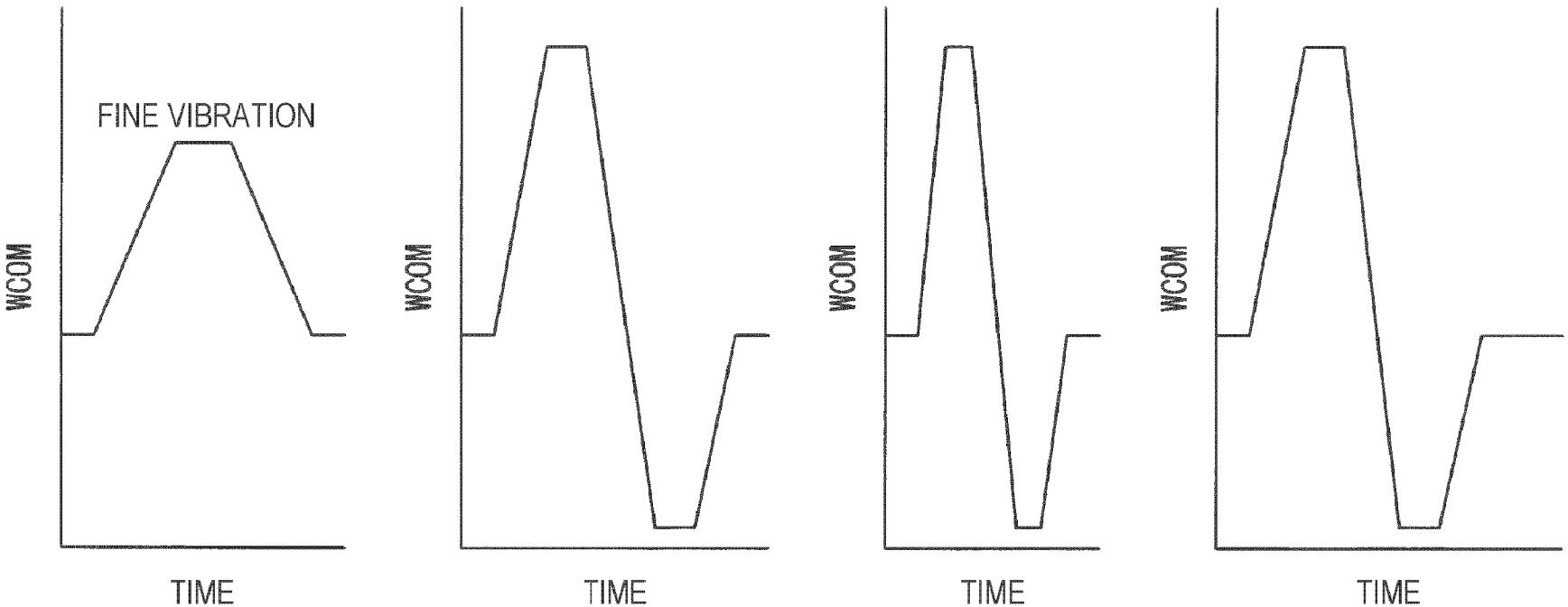
FIG. 4 is an explanatory diagram of the drive waveform signals in various forms.
Figure 5:
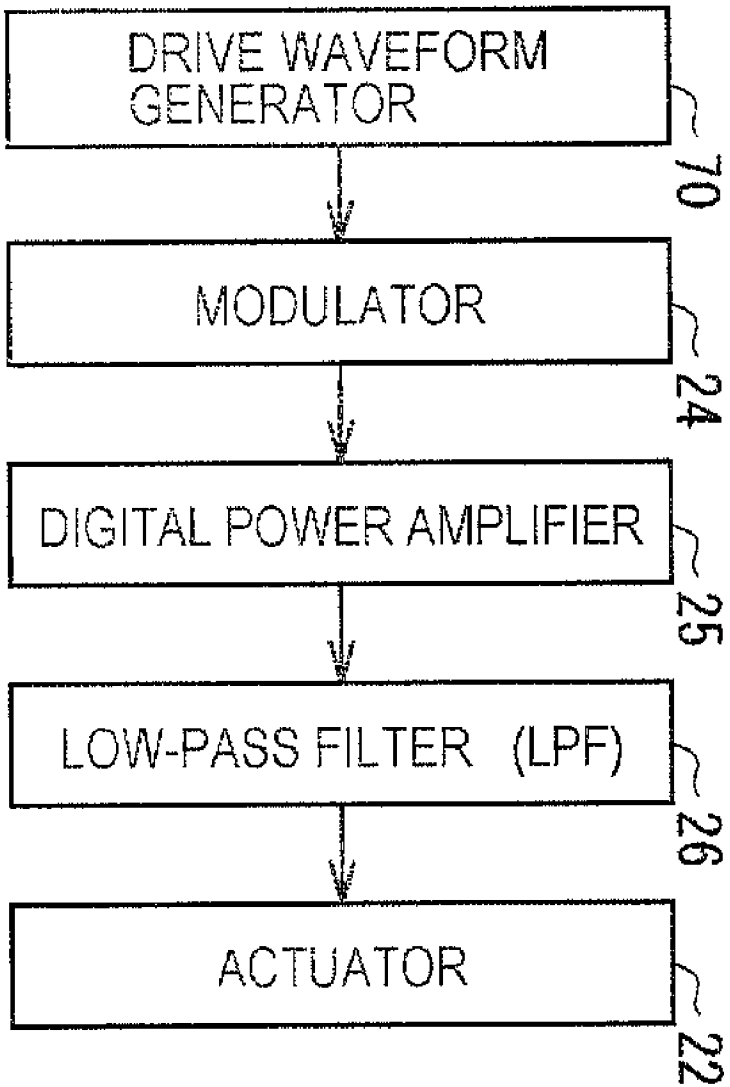
FIG. 5 is a block configuration diagram of the drive circuit as a unit.

The drive waveform signal WCOM thus generated can be obtained as trapezoidal voltage wave signals with various waveforms shown in FIG. 4 by adjusting the waveform data. By power-amplifying this signal by the drive circuit shown in FIG. 5 and then supplying it to the actuator 22 of the liquid jet heads 2, 3 as the drive pulse, the actuator can be driven and the liquid jet can be emitted from the nozzle corresponding to the actuator. The drive circuit is configured including, for every actuator as described below, a modulator 24 for performing the pulse width modulation on the drive waveform signal WCOM generated by the drive waveform generator 70, a digital power amplifier 25 for performing the power amplification on the modulated (PWM) signal on which the pulse width modulation is performed by the modulator 24, and a low pass filter 26 for smoothing the modulated (PWM) signal power-amplified by the digital power amplifier 25.

The rising portion of the drive waveform signal WCOM or the drive pulse corresponds to the stage of expanding the capacity of the cavity (pressure chamber) communicating the nozzle to pull in the liquid (it can be said that the meniscus is pulled in considering the emission surface of the liquid) and the falling portion of the drive signal COM corresponding to the stage of reducing the capacity of the cavity to push out the liquid (it can be said that the meniscus is pushed out considering the emission surface of the liquid), as a result of pushing out the liquid, the liquid jet is emitted from the nozzle. The series of waveform signals from pulling in the liquid to pushing out the liquid according to needs are assumed to form the drive pulse.

By variously changing the gradient of increase and decrease in voltage and the height of the drive pulse formed of this trapezoidal voltage wave, the pull-in amount and the pull-in speed of the liquid, and the push-out amount and the push-out speed of the liquid can be changed, thus the amount of liquid jet can be changed to obtain a different size of the liquid dot, and by forming the liquid dots with different sizes, finer tone can be achieved. It should be noted that the drive pulse shown in the left end of FIG. 4 is only for pulling in the liquid but not for pushing out the liquid. This is called a fine vibration, and is used for preventing the nozzle from drying without emitting the liquid jet.

Figure 6:
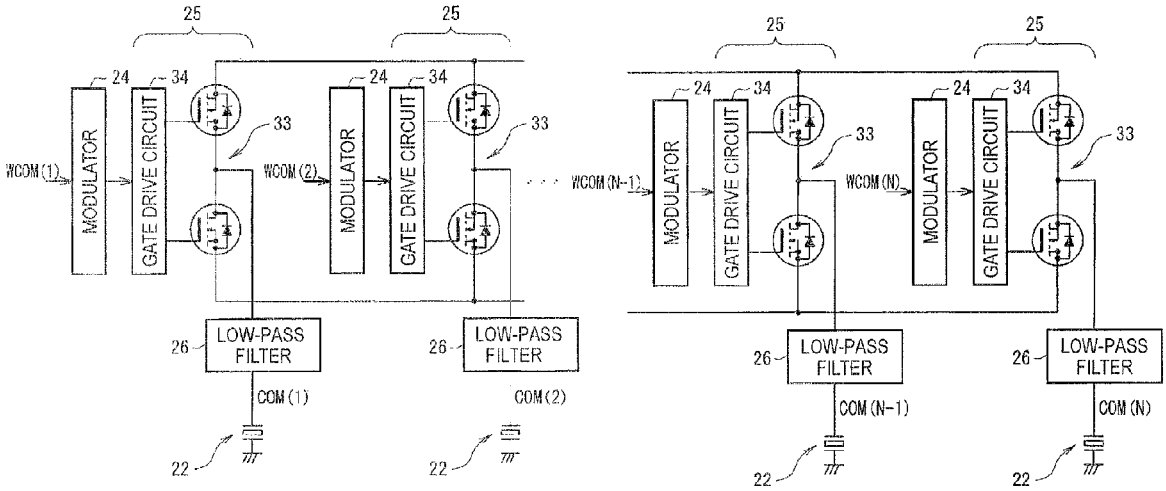
FIG. 6 is a block diagram showing the overall configuration of the drive circuit.

FIG. 6 shows the overall configuration of the drive circuit separately provided to each of the actuators 22. As described above, since in the present embodiment the individual drive waveform signal WCOM to each of the actuators 22 is set by the drive waveform generator 70, assuming that the number of the actuators 22 is N, N drive waveform signals WCOM(1) through WCOM(N) are output and applied to the N actuators 22 via the individual drive circuits.

Figure 7:
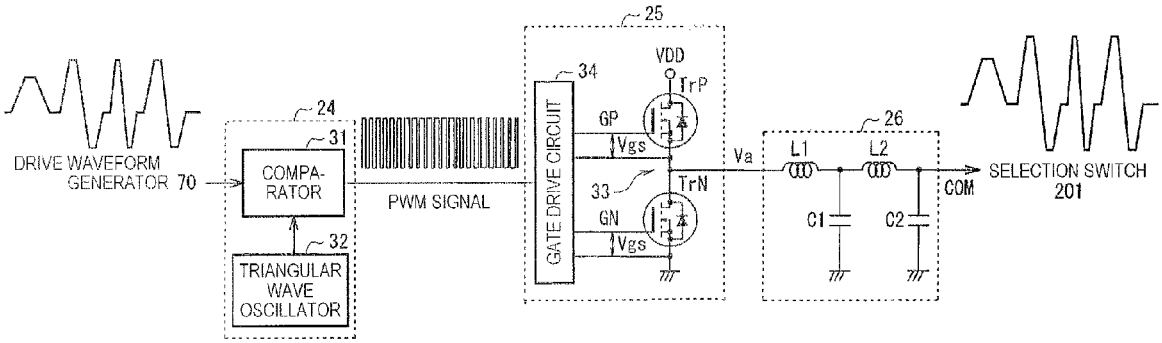
FIG. 7 is a block diagram showing details of the modulator, the digital power amplifier, and the low-pass filter of the drive circuit shown in FIG. 5.
Figure 8:
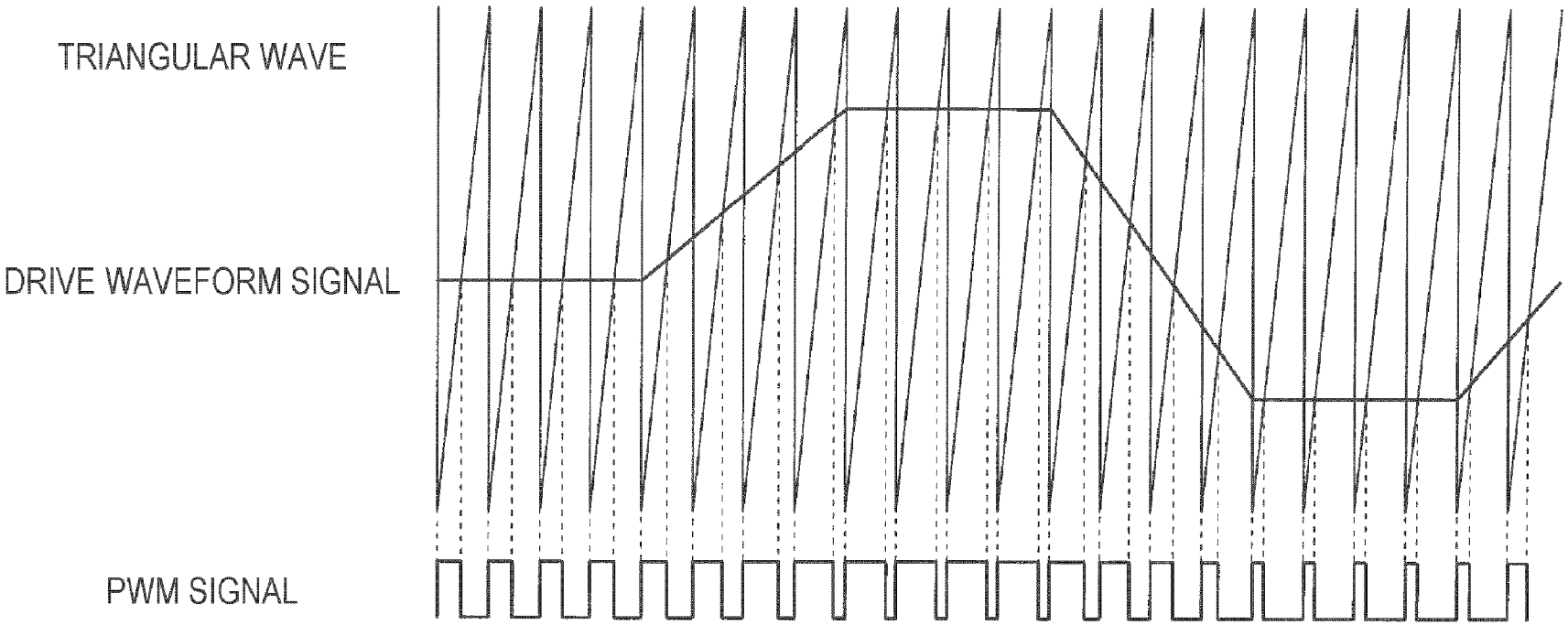
FIG. 8 is an explanatory diagram of the operation of the modulator shown in FIG. 7.

FIG. 7 shows a specific configuration from the modulator 24 of the drive signal output circuit described above to the low-pass filter 26. As the modulator 24 for performing the pulse width modulating on the drive waveform signal WCOM, a common pulse width modulation (PWM) circuit is used. The modulator 24 is composed of a well-known triangular wave oscillator 32, and a comparator 31 for comparing the triangular wave output from the triangular wave oscillator 32 with the drive waveform signal WCOM. According to the modulator 24, as shown in FIG. 8, the modulated (PWM) signal, which is set to HIGH level when the drive waveform signal WCOM exceeds the triangular wave, and is set to LOW level when the drive waveform signal WCOM is lower than the triangular wave, is output. It should be noted that although in the present embodiment the pulse width modulation circuit is used as the pulse modulator, a pulse density modulation (PDM) circuit can also be used instead.

Figure 9:
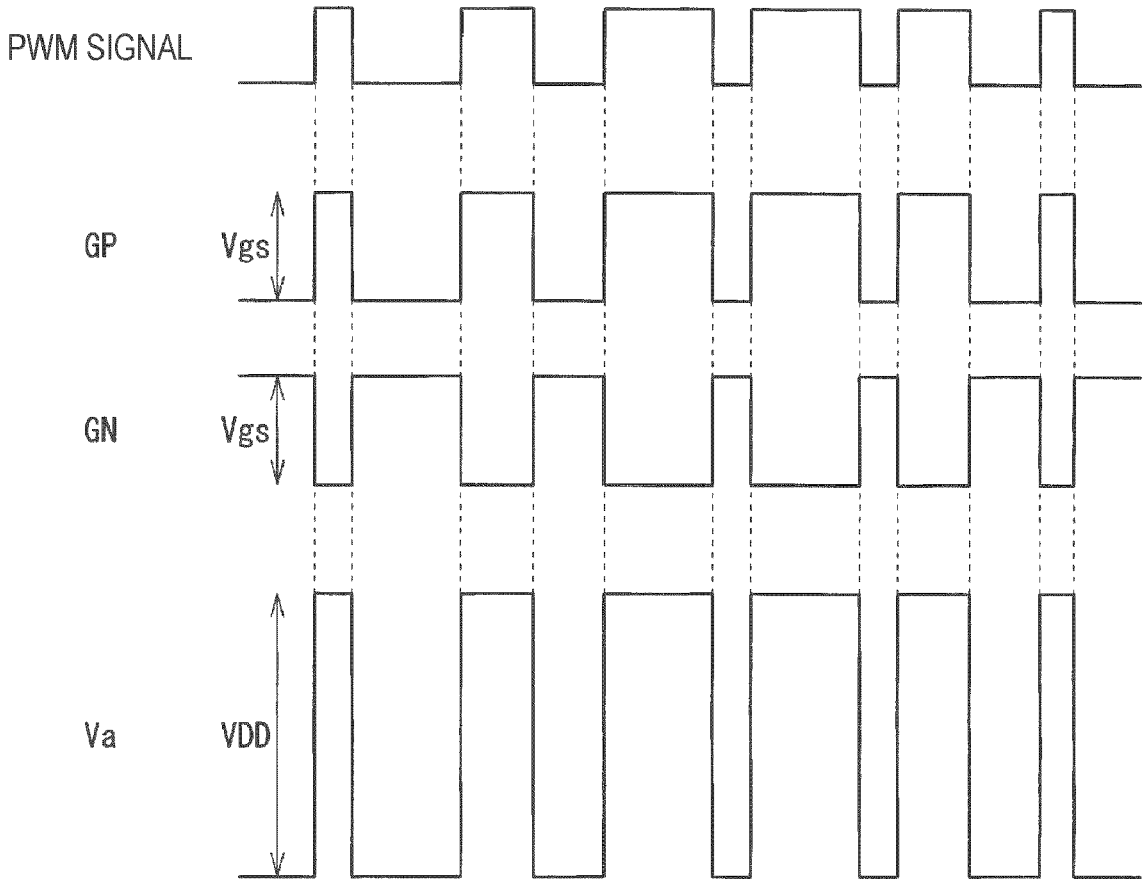
FIG. 9 is an explanatory diagram of the operation of the digital power amplifier shown in FIG. 8.

The digital power amplifier 25 is configured including a half-bridge driver stage 33 composed of two MOSFET TrP, TrN for substantially amplifying the power, and a gate drive circuit 34 for controlling the gate-source signals GP, GN of the MOSFET TrP, TrN based on the modulated (PWM) signal from the modulator 24, and the half-bridge driver stage 33 is formed by combining the high-side MOSFET TrP and the low-side MOSFET TrN in a push-pull manner. Assuming that the gate-source signal of the high-side MOSFET TrP is GP, the gate-source signal of the low-side MOSFET TrN is GN, and the output of the half-bridge driver stage 33 is Va, FIG. 9 shows how these signals vary in accordance with the modulated (PWM) signal. It should be noted that the voltage values Vgs of the gate-source signals GP, GN of the respective MOSFET TrP, TrN are assumed to be sufficient to turn on the MOSFET TrP, TrN.

When the modulated (PWM) signal is in the HIGH level, the gate-source signal GP of the high-side MOSFET TrP becomes in the HIGH level while the gate-source signal GN of the low-side MOSFET TrN becomes in the LOW level, the high-side MOSFET TrP becomes the ON state while the low-side MOSFET TrN becomes the OFF state, and as a result, the output Va of the half-bridge driver stage 33 becomes in the supply voltage VDD. On the other hand, when the modulated (PWM) signal is in the LOW level, the gate-source signal GP of the high-side MOSFET TrP becomes in the LOW level while the gate-source signal GN of the low-side MOSFET TrN becomes in the HIGH level, the high-side MOSFET TrP becomes the OFF state while the low-side MOSFET TrN becomes the ON state, and as a result, the output Va of the half-bridge driver stage 33 becomes zero.

The output Va of the half-bridge driver stage 33 of the digital power amplifier 25 is supplied to the selection switch 201 as the drive signal COM via the low-pass filter 26. The low-pass filter 26 is formed of a low-pass filter composed of a combination of two coils L1, L2, and two capacitors C1, C2. The low-pass filter 26 formed of the low pass filter is designed to sufficiently attenuate the high frequency component of the output Va of the half-bridge driver stage 33 of the digital power amplifier 25, namely the power amplified modulated (PWM) signal component, and at the same time, not to attenuate the drive signal component COM (or alternatively, the drive waveform component WCOM).

As described above, when the MOSFET Tr P, TrN of the digital power amplifier 25 are driven in a digital manner, since the MOSFET acts as a switch element, although the current flows in the MOSFET in the ON state, the drain-source resistance is extremely small, and the power loss is hardly caused. Further, since no current flows in the MOSFET in the OFF state, the power loss does not occur. Therefore, the power loss of the digital power amplifier 25 is extremely small, the small-sized MOSFET can be used, and the cooling unit such as a heat radiation plate for cooling can be eliminated. Incidentally, the efficiency in the case in which the transistor is driven in the linear range is about 30% while the efficiency of digital power amplifier is higher than 90%. Further, since the heat radiation plate for cooling the transistor requires about 60 mm square in size for each transistor, if such a radiation plate can be eliminated, an overwhelming advantage in the actual layout can be obtained.

Figure 10:
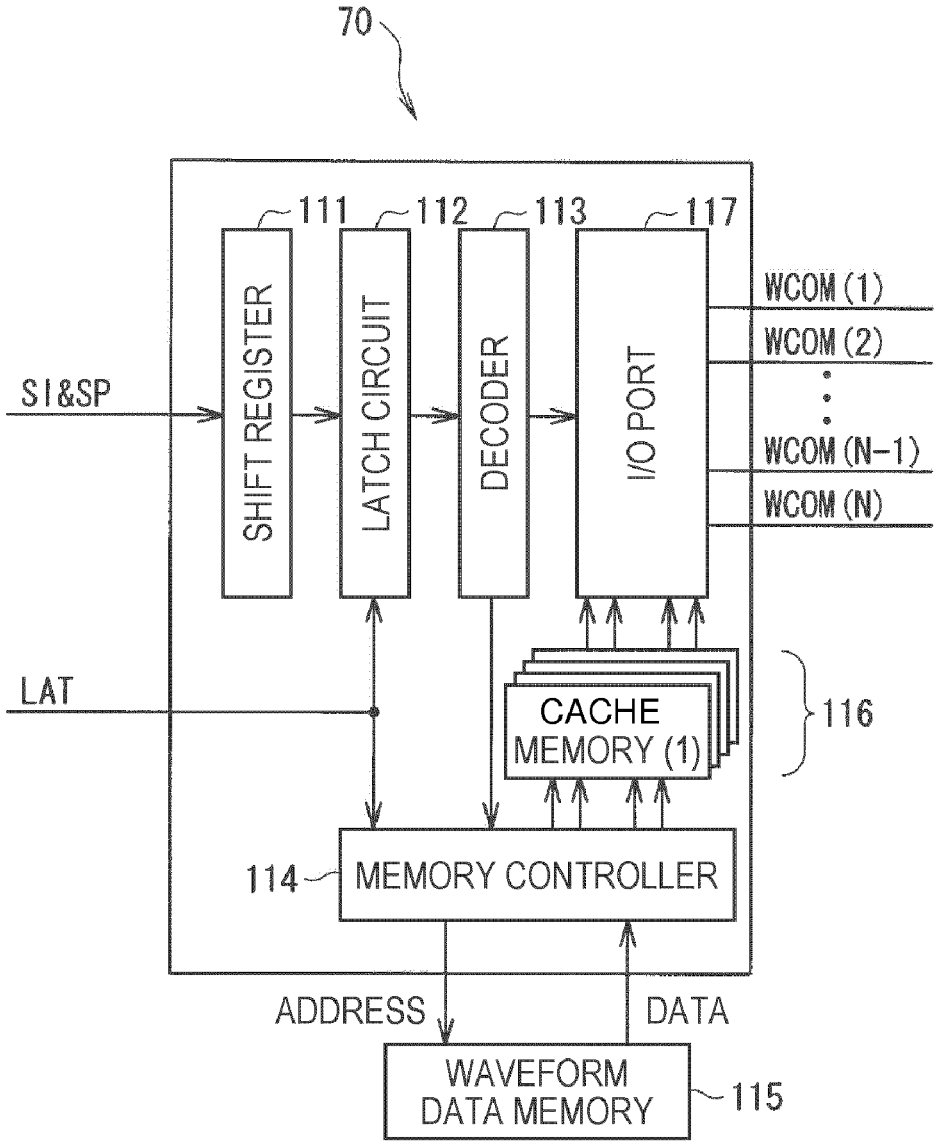
FIG. 10 is a block diagram of a drive waveform generator.

Subsequently, the configuration and the operation of the drive waveform generator 70 will be explained. The drive waveform generator 70 is configured as shown in FIG. 10, and provided with a shift resistor 111 for sequentially storing the drive pulse selection data SI&SP for designating the actuator corresponding to the nozzle from which the liquid jet is emitted, a latch circuit 112 for temporarily storing the data of the shift register 111 in accordance with a latch signal LAT, a decoder 113 for decoding the data of the latch circuit 112, a waveform data memory 115 for storing the waveform data corresponding to the actuator 22 as described above, a memory controller 114 for retrieving the waveform data stored in the waveform data memory 115 and storing it in a cache memory 116 corresponding to the actuator 22 in accordance with the data decoded by the decoder 113 and the latch signal LAT by performing the arithmetic processing shown in FIG. 12 described below, and an I/O port 117 for outputting the waveform data stored in the cache memory 116 to the modulator 24 of the drive circuit in accordance with the latch signal LAT and the data decoded by the decoder 113.

Here, the reason why the drive waveform generator 70 outputs the drive waveform signals WCOM corresponding to the actuators 22 will be explained. Since the actuator 22 formed of a piezoelectric element or the like has a capacitance, if all of the actuators for emitting the liquid jet are connected to one drive pulse in parallel to each other, a low-pass filter is formed of the parasitic inductances, the parasitic capacitances, and the resistances of the actuators and the wiring of the drive circuit, thus the drive pulses are distorted. Moreover, since the characteristic of the low-pass filter by the capacitances of the actuators varies when the number of nozzles for emitting the liquid jet, namely the number of actuators to be driven varies, the state of the distortion of the drive pulse also varies. Every time the actuator 22 such as a piezoelectric element is connected to the low-pass filter, the capacitance is additionally connected in parallel one after another, thus the characteristic of the low-pass filter by the low-pass filter and the capacitances of the actuators should be varied. When the state of the distortion of the drive pulse varies, the weight of the liquid emitted from the nozzle also varies, as a matter of course.

Therefore, in the present embodiment, an individual drive circuit is disposed to each of the actuators 22, and an individual drive waveform signal WCOM is output to each of the drive circuit and each of the actuators 22. Since the variation in the distortion of the drive pulse in accordance with the variation in the number of the actuators 22 is eliminated by disposing the individual drive circuit to each of the actuators 22, the variation in the weight of the liquid emitted from the nozzle can be suppressed even with the common drive waveform signal WCOM. However, individual differences also exist in the nozzles and the actuators 22 themselves, and accordingly, even if the drive circuits of the actuators 22 are provided individually, the weight variation in the liquid jet emitted from different nozzles is caused by the common drive waveform signal WCOM.

In consideration of the individual difference among the nozzles and the actuators 22, in the present embodiment, as shown in FIG. 11A, small liquid dot waveform data (small ink droplet waveform data, in the drawing) of the drive waveform signal most appropriate for the drive pulse when forming a small liquid dot, medium liquid dot waveform data (medium ink droplet waveform data, in the drawing) of the drive waveform signal most appropriate for the drive pulse when forming a medium liquid dot, and large liquid dot waveform data (large ink droplet waveform data, in the drawing) of the drive waveform signal most appropriate for the drive pulse when forming a large liquid dot are obtained for N nozzles and actuators by measurement, and the data is stored into the waveform data memory 115 corresponding to the address numbers 1 though M in the order of the nozzle number 1 through N.

In this case, the memory controller 114 accesses the address number 2 of the waveform data memory 115 in FIG. 11A in accordance with the drive pulse selection data SI&SP when the medium liquid dot is required for the nozzle number 1, accesses the address number 4 of the waveform data memory 115 when the small liquid dot is required for the nozzle number 2, and stores the waveform data stored therein corresponding to these address numbers in the cache memory 116 corresponding thereto. The waveform data stored in all of the cache memories 116 are simultaneously output from the I/O port 117 as the drive waveform signals WCOM in a predetermined sampling cycle after a predetermined period of time t has elapsed from the latch signal LAT.

It should be noted that in order for decreasing the storage capacity of the waveform data memory 115, similar waveform data out of the waveform data to all of the actuators 22 of the nozzles shown in FIG. 11A are put together, and stored corresponding to the addresses by a shape like small ink droplet waveform data A, medium ink droplet waveform data A, large ink droplet waveform data A, small ink droplet waveform data B, medium ink droplet waveform data B, and so on as shown in FIG. 11B. In this case, the memory controller 114 accesses the address number 5 of the waveform data memory 115 in FIG. 11B in accordance with the drive pulse selection data SI&SP when the medium liquid dot is required for the nozzle number 1, accesses the address number 1 of the waveform data memory 115 when the small liquid dot is required for the nozzle number 2, and stores the waveform data stored therein corresponding to these address numbers in the cache memory 116 corresponding thereto. The waveform data stored in all of the cache memories 116 are simultaneously output from the I/O port 117 as the drive waveform signals WCOM in a predetermined sampling cycle after a predetermined period of time t has elapsed from the latch signal LAT.

Figure 12:
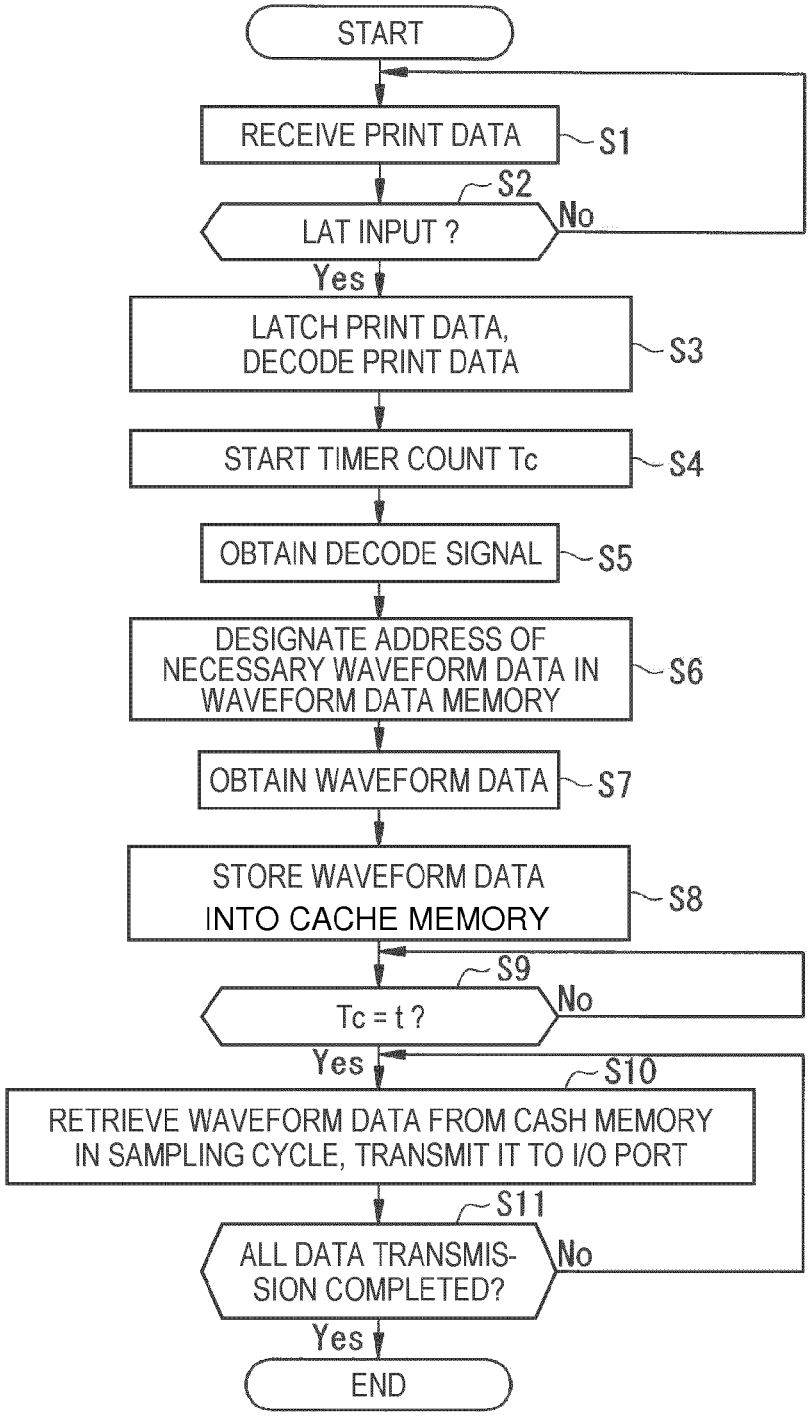
FIG. 12 is a flowchart showing arithmetic processing of a waveform data output performed by the memory controller shown in FIG. 10.

FIG. 12 shows the arithmetic processing for retrieving and outputting the waveform data performed in the memory controller 114 of FIG. 10. In this arithmetic processing, the drive pulse selection data (print data in the drawing) SI&SP is received firstly in the step S1.

Subsequently, the process proceeds to the step S2 to judge whether or not the latch signal LAT is input, and if the latch signal LAT has been input, the process proceeds to the step S3, otherwise the process proceeds to the step S1.

In the step S3, the drive pulse selection data (the print data) SI&SP thus received is latched by the latch circuit 112, and further deciphered (decoded in the drawing) by the decoder 113.

Then, the process proceeds to the step S4 to start the timer count Tc.

Subsequently, the process proceeds to the step S5 to obtain the data (the decoder signal in the drawing) deciphered by the decoder 113.

Then, the process proceeds to the step S6 to designate the address of the waveform data memory 115 for obtaining the waveform data necessary for each of the actuators.

Then, the process proceeds to the step S7 to access the address of the waveform data memory 115, thus obtaining the waveform data necessary for each of the actuators.

Subsequently, the process proceeds to the step S8 to store the waveform data obtained in the step S7 into the corresponding cache memory 116.

Subsequently, the process proceeds to the step S9 to judge whether or not the timer count Tc has reached the predetermined time period t, and if the timer count Tc has reached the predetermined time period t, the process proceeds to the step S10, otherwise the process becomes the standby state.

In the step S10, the waveform data is retrieved from the cache memory 116 in the sampling cycle, and output from the I/O port 117.

Subsequently, the process proceeds to the step S11 to judge whether or not the transmission of all of the waveform data has been completed, and if the transmission of all of the waveform data has been completed, the process returns to the main program, otherwise the process proceeds to the step S10.

Figure 13:
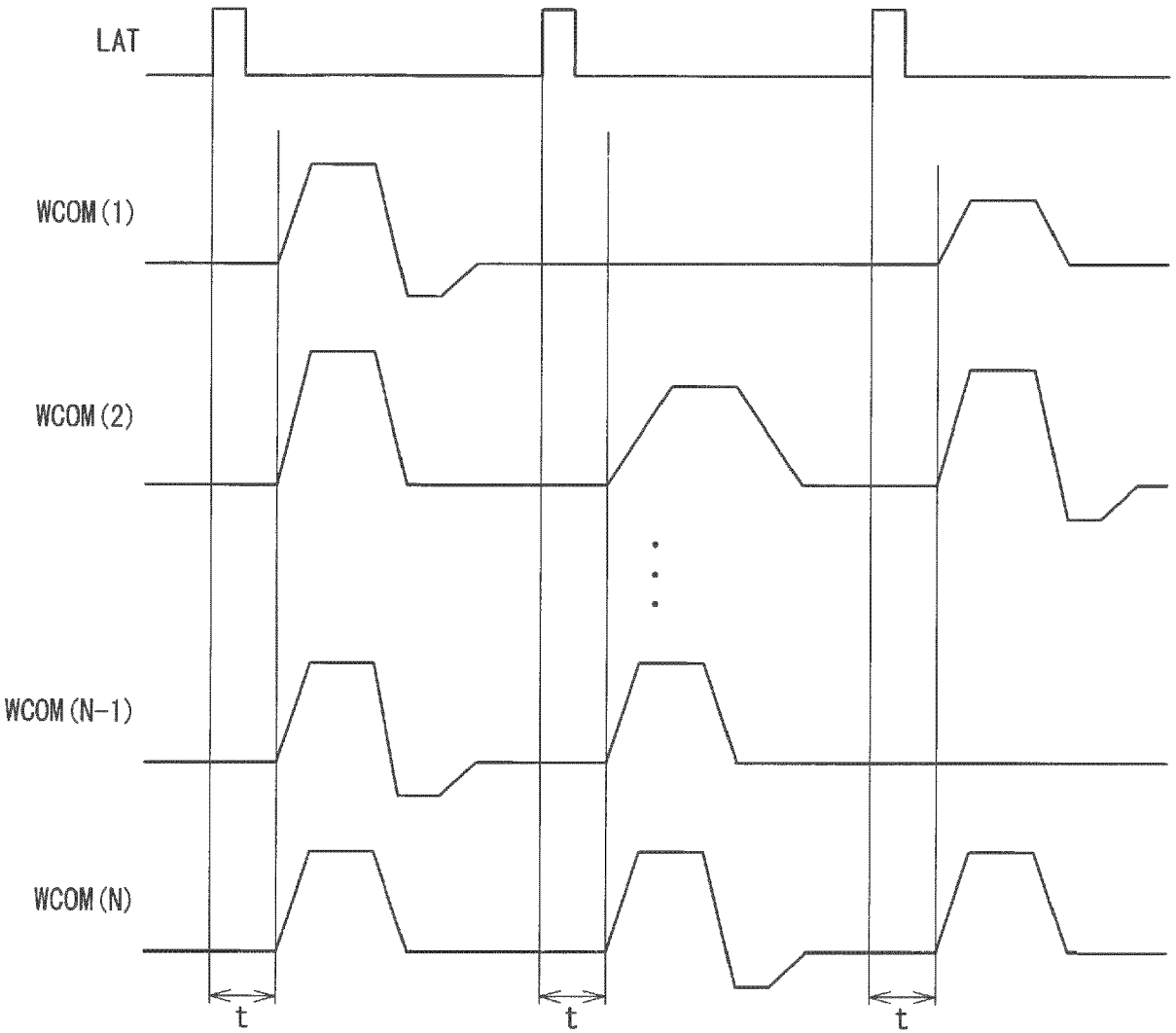
FIG. 13 is an explanatory diagram of a drive waveform signal by the arithmetic processing shown in FIG. 12.

According to the arithmetic processing, as shown in FIG. 13, the waveform data is output every predetermined sampling time period after the predetermined time period t has elapsed from the latch signal LAT, thus the drive waveform signals WCOM are output simultaneously to the actuators 22 of all of the nozzles from which the liquid jets are emitted, and the signals are power-amplified by the respective drive circuits to be converted into the drive pulses, and are applied to the respective actuators 22. Since only one actuator 22 is connected to one drive pulse, the drive pulse is never distorted.

As described above, according to the printing apparatus of the present embodiment, since the same number of the half-bridge driver stages 33 (transistor pairs) each composed of two transistors MOSFET TrP, TrN forming a pair connected in a push-pull manner as the number of the actuators are provided for power-amplifying the drive waveform signals WCOM as bases of the drive pulses to the actuators 22, and the low-pass filters 26 are provided between the connection points of the pairs of transistors MOSFET TrP, TrN of these half-bridge driver stages 33 (the transistor pairs) and the actuators 22, resulting that only one actuator 22 is connected to the drive circuit composed of the half-bridge driver stage 33 (the transistor pairs) and the low-pass filter 26, the waveform distortion of the drive pulse can be prevented, thus the variation in the liquid weight can be suppressed and prevented, thereby making it possible to perform high quality and fine tone printing.

Further, since the same number of the modulators 24 for performing the pulse-modulation of the drive waveform signals WCOM and the same number of the gate drive (driving) circuits 34 for driving the half-bridge driver stages 33 (the transistor pairs) based on the pulse-modulated modulation signal as the number of the half-bridge driver stages 33 (the transistor pairs) are provided to individually control the half-bridge driver stages 33 (the transistor pairs) in accordance with the respective drive waveform signals WCOM, the variation in the liquid weight among the nozzles can be suppressed and prevented by generating the drive waveform signals WCOM corresponding to the actuators 22 of the drive circuits and the nozzles, thus making it possible to perform the high quality and fine tone printing.

Further, by generating the drive waveform signal WCOM for every corresponding actuator 22 in accordance with the waveform data corresponding to the actuator 22 and stored in the waveform data memory 115, the variation in the liquid weight among the nozzles can be suppressed and prevented, thus making it possible to perform the high quality and fine tone printing.

Further, since the configuration of simultaneously generating the drive waveform signals WCOM to all of the actuators 22 corresponding to the nozzles from which the liquid jets are emitted with the timing of emitting the liquid jets from the nozzles is adopted, the shift in the liquid jet emission timing among the nozzles can be prevented, and thus making it possible to perform high quality and fine tone printing.

Further, since the modulators 24, the gate drive (driving) circuits 34, the half-bridge driver stages 33 (the transistor pairs), and the low-pass filters 26 are disposed adjacent to the actuators 22 as an integrated circuit, the power loss can be reduced to achieve low power consumption, and a plurality of liquid jet heads can efficiently be arranged, thus downsizing of the printing apparatus becomes possible.

Further, since the transistor pair is connected to every actuator 22, the current flowing through the transistor pair can be reduced, thus it becomes possible to configure the transistor pair using transistors capable of operating at higher speed to increase the modulation frequency to simplify the low-pass filter. For example, the low-pass filter can be composed of a first-order RC filter, or can be composed of only a resistor utilizing the capacitance of the actuator, or the configuration in which the low-pass filter is composed of the resistor components of the wiring and the transistors and the capacitance component of the actuator without separately providing the low-pass filter in effect can also be adopted.

It should be noted that although in the present embodiment, the example applying the present invention taking the line head printing apparatus as a target is only explained in detail, the liquid jet apparatus and the printing apparatus according to the present invention can also be applied to a multi-pass printing apparatus or any other types of printing apparatuses for printing letters or images on a print medium by emitting liquid jet as a target thereof. Further, each section configuring the liquid jet apparatus or the printing apparatus of the present invention can be replaced with an arbitrary configuration capable of exerting a similar function, or added with an arbitrary configuration.

Further, as a liquid emitted from the liquid jet apparatus of the present invention, there is no particular limitation, and liquids (including dispersion liquids such as suspensions or emulsions) containing various kinds of materials as mentioned below can be cited, for example. Specifically, ink containing a filter material of a color filter, a light emitting material for forming an EL light emitting layer in an organic electroluminescence (EL) device, a fluorescent material for forming a fluorescent substance on an electrode in a field emission device, a fluorescent material for forming a fluorescent substance in a plasma display panel (PDP) device, electrophoretic material for forming an electrophoretic substance in an electrophoretic display device, a bank material for forming a bank on a substrate W, various coating materials, a liquid electrode material for forming a electrode, a particle material for forming a spacer for forming a microscopic cell gap between two substrates, a liquid metal material for forming metal wiring, a lens material for forming a microlens, a resist material, a light diffusion material for forming a light diffusion material, and so on can be cited.

Further, in the present invention, the print medium to be a target of the liquid jet emission is not limited to a piece of paper such as a recording sheet, but can be a film, a cloth, a nonwoven cloth, or other medium, or works such as various substrates such as a glass substrate, or a silicon substrate.

What is claimed is:

1. A liquid jet device comprising:

a plurality of nozzles provided to a liquid jet head;

an actuator provided corresponding to each of the nozzles; and drive unit for applying a drive pulse to the actuator, wherein the drive unit includes drive waveform signal generation unit that generates one or more of drive waveform signals each providing basis of the drive pulse to the actuator, one or more of transistor pairs provided as many as the number of the actuators in order for power-amplifying the one or more of drive waveform signals generated by the drive waveform signal generation unit, and each having two transistors forming a pair and connected to each other in a push-pull manner, and one or more of low-pass filters provided as many as the number of the actuators and each disposed between a connection point of the transistor pair and the actuator.

2. The liquid jet apparatus according to claim 1, further comprising:

one or more of modulator unit provided as many as the number of the transistor pairs and for pulse-modulating the drive waveform signal generated by the drive waveform signal generation unit; and one or more of gate drive unit provided as many as the number of the transistor pairs and each driving the transistor pair in accordance with a modulated signal pulse-modulated by the modulator unit, wherein the transistor pair is controlled individually in accordance with the drive waveform signal.

3. The liquid jet apparatus according to claim 2, further comprising:

a waveform data memory for storing waveform data corresponding to the actuators, wherein the drive waveform signal generation unit generates the drive waveform signal for each actuator in accordance with the corresponding waveform data stored in the waveform data memory.

4. The liquid jet apparatus according to claim 3, wherein the drive waveform signal generation unit generates the drive waveform signals simultaneously to all of the actuators corresponding to the nozzles from which the liquid jet is emitted with timing of emitting the liquid jet from the nozzles.

5. The liquid jet apparatus according to claim 2, wherein the modulator unit, the gate drive unit, the transistor pairs, and the low-pass filters are disposed adjacent to the actuators as an integrated circuit.

6. A printing apparatus comprising:

a plurality of nozzles provided to a liquid jet head;

an actuator provided corresponding to each of the nozzles; and drive unit that applies a drive pulse to the actuator, wherein the drive unit includes drive waveform signal generation unit that generates one or more of drive waveform signals each providing basis of the drive pulse to the actuator, one or more of transistor pairs provided as many as the number of the actuators in order for power-amplifying the one or more of drive waveform signals generated by the drive waveform signal generation unit, and each having two transistors forming a pair and connected to each other in a push-pull manner, and one or more of low-pass filters provided as many as the number of the actuators and each disposed between a connection point of the transistor pair and the actuator.

7. The printing apparatus according to claim 6, further comprising:

one or more of modulator unit provided as many as the number of the transistor pairs and for pulse-modulating the drive waveform signal generated by the drive waveform signal generation unit; and one or more of gate drive unit provided as many as the number of the transistor pairs and each driving the transistor pair in accordance with a modulated signal pulse-modulated by the modulator unit, wherein the transistor pair is controlled individually in accordance with the drive waveform signal.

8. The printing apparatus according to claim 7, further comprising:

a waveform data memory for storing waveform data corresponding to the actuators, wherein the drive waveform signal generation unit generates the drive waveform signal for each actuator in accordance with the corresponding waveform data stored in the waveform data memory.

9. The printing apparatus according to claim 8 wherein the drive waveform signal generation unit generates the drive waveform signals simultaneously to all of the actuators corresponding to the nozzles from which the liquid jet is emitted with timing of emitting the liquid jet from the nozzles.

10. The printing apparatus according to claim 7 wherein the modulator unit, the gate drive unit, the transistor pairs, and the low-pass filters are disposed adjacent to the actuators as an integrated circuit.

* * * * *